US005992174A

United States Patent [19]

Mittelstrass

[11] Patent Number: 5,992,174

[45] Date of Patent: Nov. 30, 1999

[54] INSERT FOR A COLLECTOR PROFILE OF A CONDENSER

[75] Inventor: Hagen Mittelstrass, Bondort, Germany

[73] Assignee: Behr GmbH & Co., Stuttgart, Germany

[21] Appl. No.: 09/047,474

[22] Filed: Mar. 25, 1998

[30] Foreign Application Priority Data

Mar. 26, 1997 [DE] Germany ..... 197 12 714

[51] Int. Cl.[6] ..... F25B 43/00

[52] U.S. Cl. ..... 62/474; 62/509; 62/512

[58] Field of Search ..... 62/509, 512, 474, 62/473; 165/110, 132

[56] References Cited

U.S. PATENT DOCUMENTS

| | | | |
|---|---|---|---|
| 3,881,546 | 5/1975 | Otsuka et al. | 165/42 |
| 4,581,903 | 4/1986 | Kerry | 62/503 |
| 5,159,821 | 11/1992 | Nakamura | 62/509 |
| 5,419,141 | 5/1995 | Burk | 62/474 |
| 5,487,279 | 1/1996 | Eybergen et al. | 62/474 |
| 5,666,791 | 9/1997 | Burk | 62/474 |

FOREIGN PATENT DOCUMENTS

| | | |
|---|---|---|
| 43 19 293 | 12/1994 | Germany . |
| 44 02 927 | 8/1995 | Germany . |
| 44 21 834 | 1/1996 | Germany . |
| 4-43271 | 2/1992 | Japan . |
| 9-053867 | 2/1997 | Japan . |
| 9-053868 | 2/1997 | Japan . |

*Primary Examiner*—Henry Bennett
*Assistant Examiner*—Melvin Jones
*Attorney, Agent, or Firm*—Evenson, McKeown, Edwards & Lenahan, P.L.L.C.

[57] ABSTRACT

In known collectors for condensers of motor vehicle air conditioners, the dryer cartridge is inserted from an upper end into the collector via a spacing rod. According to the invention, the dryer cartridge can be secured by releasable connecting means to the sealing lid, and the sealing lid can be mounted on the end associated with the flow segment of the collector profile.

7 Claims, 3 Drawing Sheets

INSERT FOR A COLLECTOR PROFILE OF A CONDENSER

BACKGROUND AND SUMMARY OF THE INVENTION

This application claims the priority of German patent document 197 12 714.2 filed Mar. 26, 1997, the disclosure of which is expressly incorporated by reference herein.

The invention relates to an insert for a collector profile of a condenser of an air conditioner of a motor vehicle with a dryer cartridge, said cartridge being insertable into the collector profile axially from one end, relative to a lengthwise axis of the collector profile, said cartridge further being positionable in a flow segment of the collector profile, as well as a sealing lid to close off one end of the collector profile.

A collector profile of a condenser of an air conditioner of a motor vehicle is known from German patent document DE 44 21 834 A1, said profile being closed off at a lower end by means of a bottom. An inlet opening as well as a return opening for the coolant, used in the condenser to be dried, is provided in a flow segment of the collector profile associated with the lower end. A dryer cartridge is also located in this lower portion, said cartridge forcibly guiding the coolant from the inlet opening through the dryer cartridge and to the return opening by means of an annular flange. The dryer cartridge is secured in the lower section of the collector profile by a spacing rod engaging the dryer cartridge, said rod extending through the collector profile up to an upper end of the collector profile and secured axially there by means of a sealing lid. The sealing lid can be screwed to this upper end of the collector profile by means of matching threads on the sealing lid and on the upper end of the collector profile, thus sealing off the interior of the collector profile.

A goal of the invention is to provide an insert of the type generally described above having a dryer cartridge which can be handled and exchanged by simplified means.

This and other goals have been achieved by providing an insert for a collector profile for a condenser of a motor vehicle air conditioner, comprising: a dryer cartridge which is insertable axially into the collector profile from one end, relative to a lengthwise axis of the collector profile, to be positioned in a flow segment at a first end of the collector profile; a sealing lid for sealing one end of the collector profile, said sealing lid being mountable on said first end of the collector profile; and a releasable connection between said dryer cartridge and said sealing lid.

This and other goals have been achieved by providing an insert for a collector profile for a condenser of a motor vehicle air conditioner, comprising: a dryer cartridge which is insertable into the collector profile through an insertion opening; a sealing lid to close said insertion opening, wherein one of the dryer cartridge and the sealing lid comprises at least one male latching element and the other of the dryer cartridge and the sealing lid comprises at least one female latching element, said at least one male latching element being releasably engagable with said at least one female latching element.

According to the invention, the dryer cartridge can be secured to the sealing lid by means of releasable connecting means, and the sealing lid can be placed on the end that faces the flow segment of the collector profile. Accordingly, the dryer cartridge can be easily replaced from the end of the collector profile that faces the flow segment. This end is the lower end in a condenser that is mounted vertically and therefore has a vertically positioned collector profile, so that the dryer cartridge can simply be replaced from below.

Furthermore, the path to be traveled during insertion and removal is shorter, and therefore installation and removal take place more rapidly, so that replacement of the dryer cartridge is considerably simplified. With operation of the sealing lid and dryer cartridge from below, improved access is provided when mounting the cartridge and removing it directly on the motor vehicle. Since the dryer cartridge is secured directly to the sealing lid, no additional spacing rod is required. The fact that the spacing rod is no longer required creates a larger storage volume in the collector profile that is designed as a container, so that a filling valve, pressure sensor, or even a sight glass can be mounted. Since the dryer cartridge is secured releasably to the sealing lid, the dryer cartridge can simply be replaced when servicing is required without the sealing lid having to be replaced as well. Therefore, the sealing lid can be reused.

According to certain preferred embodiments of the invention, the releasable connecting means comprise latching elements provided on the dryer cartridge or on the sealing lid, and matching latching locations are provided, said locations being associated with the sealing lid or the dryer cartridge and receiving the latching elements. The formwise latching connection thus created allows especially simple installation and removal of the dryer cartridge at the sealing lid. If both the dryer cartridge and the sealing lid are designed as plastic parts, the latching elements and latching locations can be molded integrally in simple fashion.

In another embodiment of the invention, the side of the dryer cartridge that is opposite the releasable connecting means is provided with a receptacle to secure one end of the spacer supporting the collector profile, said end being opposite the flow segment. As a result, the dryer cartridges can also be used alternatively in known systems, in which they are inserted from above into the collector profile.

In another embodiment of the invention, the end of the collector profile that is opposite the flow segment is made identical to the end facing the flow segment in such fashion that the sealing lid can be secured at either end. As a result, the sealing lid can be employed for both a design with a spacing rod and a design without a spacing rod. This creates a modular design for the sealing lid, and also a modular design for the dryer cartridge in conjunction with the embodiments described above.

In another embodiment of the invention, the dryer cartridge is provided with an annular flange projecting radially outward for separating an inflow area and a return area in the flow segment of the collector profile, and the collector profile has an annular projection for axial support of the annular flange when the dryer cartridge is in the mounted position. In addition to the radial seal already known from the prior art, the annular flange thus is provided with an axial seal by virtue of its axial support on the annular projection. This produces an improved sealing effect between the inlet and return areas for the coolant.

Other objects, advantages and novel features of the present invention will become apparent from the following detailed description of the invention when considered in conjunction with the accompanying drawings.

DETAILED DESCRIPTION OF THE DRAWINGS

Figure 1:
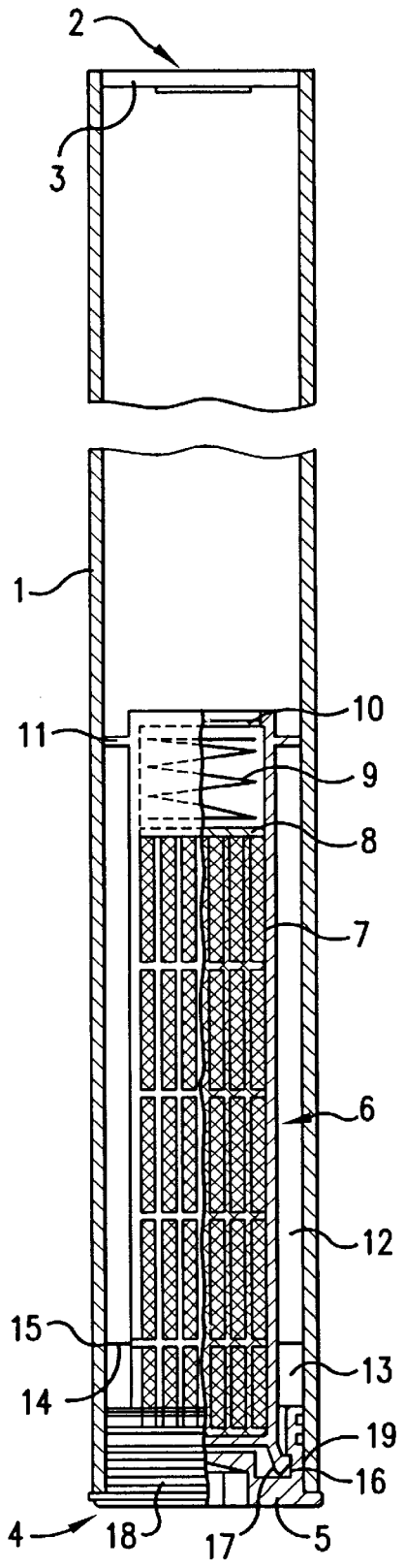
FIG. 1 shows a lengthwise section through a collector profile of a condenser for an air conditioner for a motor vehicle, according to one preferred embodiment of the present invention.
Figure 2:
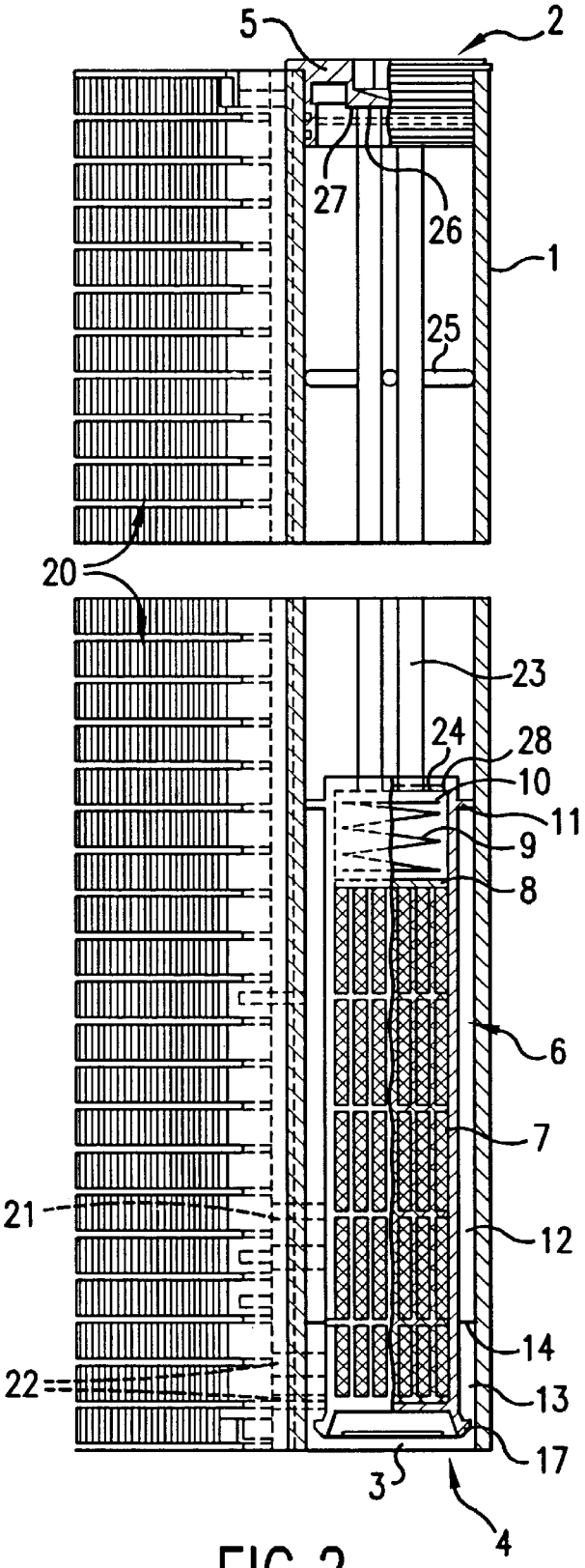
FIG. 2 is a lengthwise section through a portion of a condenser provided with a collector profile similar to FIG. 1, according to another preferred embodiment of the present invention.

Referring to FIGS. 1 and 2, a condenser for an air conditioner of a motor vehicle has a tubular collector profile 1, connected laterally to a rib/tube block 20 which is aligned vertically when the condenser is mounted vertically. Collector profile 1 is connected in a manner not shown in greater detail by an inlet opening 21 and a return opening 22 with a collecting tube of the condenser. Collector profile 1 extends over the entire height of rib/tube block 20 and in the embodiment shown in FIG. 1 has a closure 3 at its upper end 2, said closure sealing collector profile 1 and being secured in collector profile 1 by hard soldering in particular. At a lower end 4 of collector profile 1, tubular collector profile 1 is sealed by a sealing lid 5 which is screwed into the lower end 4 of collector profile 1. For this purpose, sealing lid 5 has an external thread 18 that engages a matching internal thread 19 in lower end 4 of collector profile 1. Sealing lid 5 has two annular grooves spaced axially with respect to one another, into which grooves O-rings can be inserted for sealing.

To dry the coolant, a dryer cartridge 6 is inserted into a lower half of collector profile 1 that is defined as a flow segment by the inlet and return openings, said cartridge being provided with a filter screen with a preferred mesh size of 0.06 to 0.1 mm. Dryer cartridge 6 is made in the shape of a tube or sleeve and has a jacket perforated in the manner of a lattice, the interior of said jacket being lined by filter screen 7. A lower end of dryer cartridge 6 is sealed by a bottom, not described in greater detail. An upper end of dryer cartridge 6 is sealed by a sealing piston 8, said piston being subjected to axial pressure relative to the lengthwise axis of collector profile 1 and dryer cartridge 6 by a compression spring 9 abutting an upper supporting end 10. A granulated dryer filling is provided in dryer cartridge 6 and also inside filter screen 7, said filling being compactly compressed by sealing piston 8.

An annular space is formed between the outer jacket of dryer cartridge 6 and the inside wall of collector profile 1, said space serving to conduct the coolant. The annular space is thus divided by a radially outward projecting annular sealing flange 14 into an upper inlet chamber 12 in which the inlet opening terminates and a lower return chamber 13 from which the return opening branches off, with the outer circumference of said flange radially abutting the inside wall of collector profile 1. In addition, an annular projection 15 is provided on the inside wall of collector profile 1, said projection constituting a step that produces a smaller inside diameter. Sealing flange 14 also axially abuts this annular projection 15. Inlet chamber 12 is delimited axially at the top by an annular sealing shoulder 11, said shoulder likewise projecting radially outward from dryer cartridge 6 and radially abutting the inside wall of collector profile 1. The lower end of return chamber 13 is delimited by sealing lid 5.

Dryer cartridge 6 has a plurality of latching noses 17 distributed like a crown around the circumference of dryer cartridge 6, said noses being designed to be elastically flexible in the radial direction. These latching noses 17 constitute the latching elements of a latching connection which serves for releasably securing dryer cartridge 6 to sealing lid 5. For this purpose, sealing lid 5 has a radial annular groove on its interior, said groove being designed as a latching location in the form of a latching groove 16. Latching groove 16 is adjusted to the dimensions of latching noses 17 in order to produce secure coaxial positioning and securing of dryer cartridge 6 to sealing lid 5. Alternatively, the latching noses may be provided on the sealing lid, with the annular groove being provided on the dryer cartridge. Sealing lid 5 is designed at the point where it axially abuts latching groove 16 in such fashion that a wedge-shaped annular space is formed around dryer cartridge 6. This wedge-shaped annular space permits engagement of a tool, especially a screwdriver, to loosen dryer cartridge 6 from sealing lid 5.

To insert dryer cartridge 6 into collector profile 1, sealing lid 5 is initially clipped by means of its latching groove 16 onto latching noses 17 of dryer cartridge 6, so that dryer cartridge 6 and sealing lid 5 are firmly connected to one another. Then dryer cartridge 6 is inserted together with sealing lid 5 from lower end 4 into collector profile 1, with sealing shoulder 11 sliding axially along the inside wall of collector profile 1. When sealing lid 5 has been screwed on, sealing flange 14 abuts annular projection 15 axially, producing the radial and simultaneously axial seal described above. As a result, a secure separation between inlet chamber 12 and return chamber 13 is produced so that the coolant is forced to flow through dryer cartridge 6 and hence through the granulated dryer filling.

Figure 3:
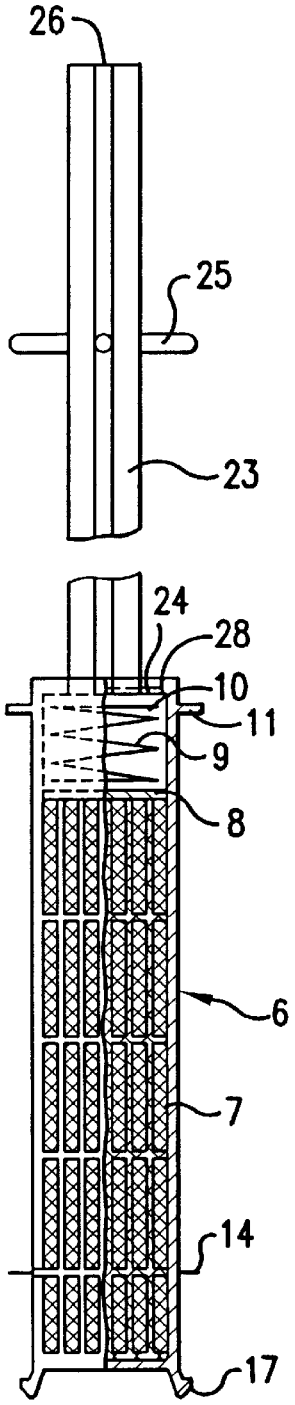
FIG. 3 shows a lengthwise section through the insert of the collector profile according to FIG. 2, said insert being composed of a dryer cartridge and a spacing part.

Dryer cartridge 6 as shown in FIGS. 2 and 3 corresponds to dryer cartridge 6 as described with reference to FIG. 1. In the embodiment shown in FIGS. 2 and 3, however, dryer cartridge 6 is inserted from upper end 2 into collector profile 1. For this purpose, closure 3 is securely attached to lower end 4 of collector profile 1, preferably by soldering to collector profile 1. The upper end of dryer cartridge 6 defines a receptacle 28 in which a retaining disk 24 of a spacing rod 23 is secured releasably by means of a latching connection, with spacing rod 23 projecting upward out of dryer cartridge 6. Retaining disk 24 in the embodiment shown is provided instead of supporting end 10 shown in FIG. 1, so that it assumes the supporting function for compressing spring 9. Spacing rod 23 has guide elements 25 projecting radially outward approximately halfway along its length, said elements radially abutting the inside wall of collector profile 1 and ensuring secure centering of spacing rod 23 over its length. A free end 26 of spacing rod 23, in the installed position, abuts a plane supporting surface 27 of sealing lid 5, said lid being screwed into the upper end 2 of collector profile 1 in the embodiment shown in FIGS. 2 and 3. For this purpose, upper end 2 of collector profile 1 is also provided with a matching internal thread.

Retaining disk 24 of spacing rod 23 is connected integrally with spacing rod 23. As soon as sealing lid 5 has been screwed completely into upper end 2, it exerts an axial pressure on free end 26 of spacing rod 23, said pressure being transmitted to compression spring 9 and hence to sealing piston 8 by spacing rod 23. As a result, secure and compact positioning of spacing rod 23 and dryer cartridge 6 within collector profile 1 is achieved.

Figure 4:
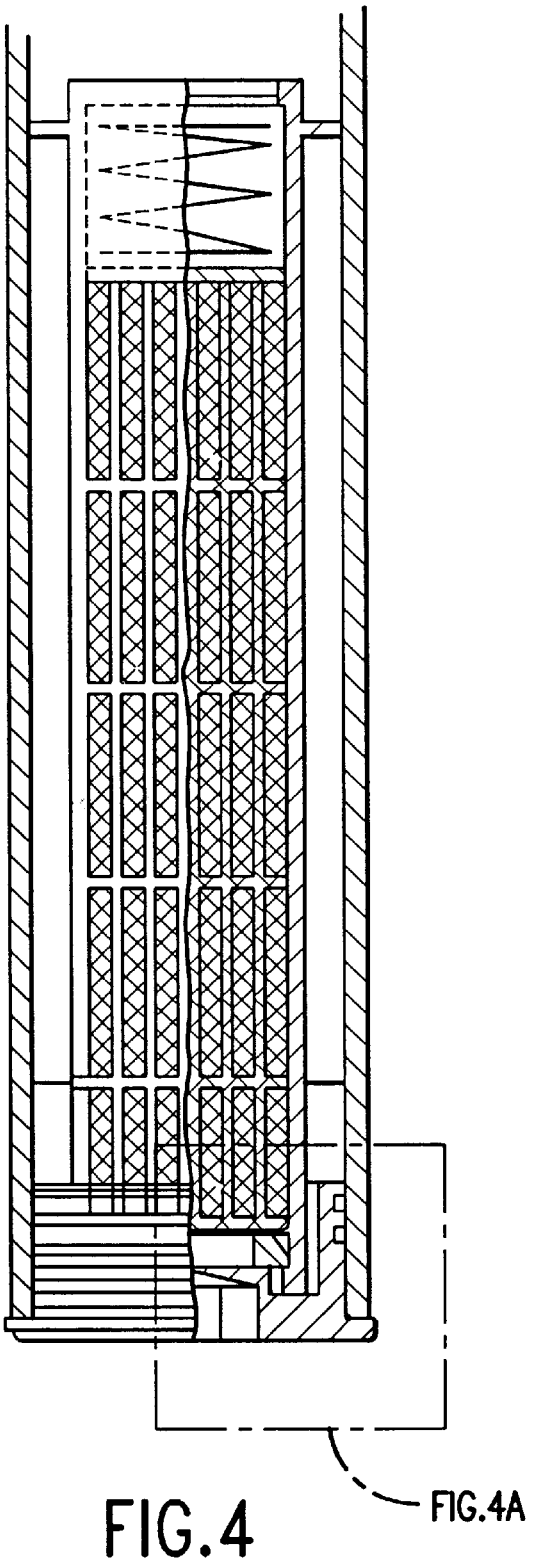
FIG. 4 shows a lengthwise section through a collector profile of a condenser for an air conditioner for a motor vehicle, according to another preferred embodiment of the present invention.
Figure 4A:
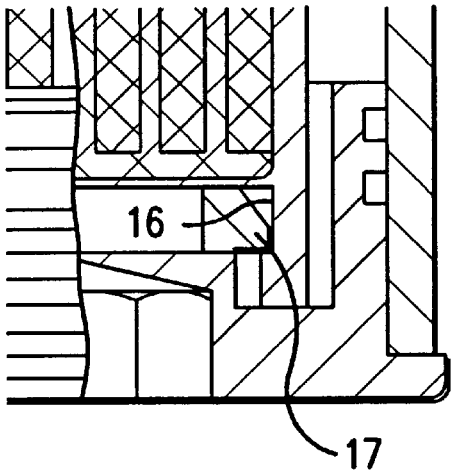

An shown in FIG. 4, the latching noes 17 may be provided an the sealing lid, with the corresponding latching groove 16 being provided in the dryer cartridge Of course, one of ordinary skill in the art would understand that any type of latching elements which are known in the art could be used, and accordingly the invention is not to be limited to the specific male-female type latching elements shown in the drawings.

The foregoing disclosure has been set forth merely to illustrate the invention and is not intended to be limiting. Since, modifications of the disclosed embodiments incorporating the spirit and substance of the invention may occur to persons skilled in the art, the invention should be construed to include everything within the scope of the appended claims and equivalents thereof.

What is claimed is:

1. An insert for a collector profile for a condenser of a motor vehicle air conditioner, comprising:

a dryer cartridge which is insertable axially into the collector profile from one end, relative to a lengthwise axis of the collector profile, to be positioned in a flow segment at a first end of the collector profile;

a sealing lid for sealing one end of the collector profile, said sealing lid being mountable on said first end of the collector profile; and a releasable connection between said dryer cartridge and said sealing lid, said releasable connection including male latching elements provided on one of the dryer cartridge and the sealing lid, and female latching elements provided on the other of the dryer cartridge and the sealing lid, said sealing lid and said dryer cartridge being connected via said male and female latching elements to form a pre-assembly unit to be inserted into the collector profile.

2. An insert according to claim 1, wherein an end of the dryer cartridge opposite said releasable connection defines a receptacle to secure a spacer that abuts a second end of the collector profile opposite the flow segment.

3. An insert according to claim 2, wherein the end of the collector profile opposite the flow segment is designed identically to the first end associated with the flow segment such that the sealing lid is mountable on either of said first and second ends.

4. An insert according to claim 1, wherein the dryer cartridge is provided with an annular flange projecting radially outward to separate an inlet area and a return area in the flow segment of the collector profile, the collector profile having an annular projection for axially supporting the annular flange when the dryer cartridge is in the mounted position.

5. An insert for a collector profile for a condenser of a motor vehicle air conditioner, comprising:

a dryer cartridge which is insertable into the collector profile through an insertion opening;

a sealing lid to close said insertion opening, wherein one of the dryer cartridge and the sealing lid comprises at least one male latching element and the other of the dryer cartridge and the sealing lid comprises at least one female latching element, said at least one male latching element being releasably engagable with said at least one female latching element, wherein said sealing lid and said dryer cartridge are connected via said male and female latching elements to form a pre-assembly unit to be inserted into the collector profile.

6. An insert according to claim 5, wherein said at least one male latching element comprises a plurality of latching noses, and said at least one female latching element comprises an annular latching groove.

7. An insert according to claim 5, wherein an end of the dryer cartridge opposite said at least one latching element defines a receptacle for engagement with a spacer, and said sealing lid includes a plane supporting surface for engagement with the spacer.

* * * * *